US006592971B2

(12) United States Patent
Ochiai et al.

(10) Patent No.: US 6,592,971 B2
(45) Date of Patent: Jul. 15, 2003

(54) IMAGE-RECEIVING FILM FOR PRINTING AND HEAT TRANSFER

(75) Inventors: Hisao Ochiai, Ibaraki (JP); Hisashi Tani, Ibaraki (JP); Hiroo Hayashi, Ibaraki (JP); Toshio Iwasaki, Osaka (JP); Mitsuo Tsuruoka, Osaka (JP)

(73) Assignee: Oji-Yuka Synthetic Paper Co., Ltd., Tokyo (JP)

( * ) Notice: Subject to any disclaimer, the term of this patent is extended or adjusted under 35 U.S.C. 154(b) by 0 days.

(21) Appl. No.: 09/726,555

(22) Filed: Dec. 1, 2000

(65) Prior Publication Data

US 2001/0003731 A1 Jun. 14, 2001

(30) Foreign Application Priority Data

Dec. 3, 1999 (JP) ..... 11-344554

(51) Int. Cl.[7] ..... B41M 5/035; B41M 5/38
(52) U.S. Cl. ..... 428/195; 503/227
(58) Field of Search ..... 428/195; 503/227

(56) References Cited

U.S. PATENT DOCUMENTS

| | | | | |
|---|---|---|---|---|
| 3,765,999 A | | 10/1973 | Toyoda | 161/170 |
| 4,420,536 A | | 12/1983 | Saunders et al. | 428/383 |
| 4,906,526 A | | 3/1990 | Inoue et al. | 428/473.5 |
| 5,527,615 A | * | 6/1996 | Kimura et al. | 428/421 |
| 5,834,098 A | | 11/1998 | Kitamura et al. | 428/195 |

FOREIGN PATENT DOCUMENTS

| | | |
|---|---|---|
| JP | 46-040794 | 12/1971 |
| JP | 56-055433 | 5/1981 |
| JP | 57-149363 | 9/1982 |
| JP | 57-181829 | 11/1982 |
| JP | 62-029447 | 6/1987 |
| JP | 8-080684 | 3/1996 |

* cited by examiner

*Primary Examiner*—Bruce H. Hess
(74) *Attorney, Agent, or Firm*—Oblon, Spivak, McClelland, Maier & Neustadt, P.C.

(57) ABSTRACT

An image-receiving film for printing and heat transfer having a support made of a thermoplastic resin film, and a coated layer having component (A) is provided, wherein (A) is an aqueous resin dispersion obtained by dispersing an olefin copolymer (a) having an unsaturated carboxylic acid or its anhydride in water using at least one agent (b) selected from the group consisting of a nonionic surface active agent, a nonionic water-soluble high molecular compound, a cationic surface active agent, and a cationic water-soluble high molecular compound, wherein the weight ratio of (a)/(b) is from 100/1 to 100/30 and (a) and (b) each have independently a mean particle size of not more than 5 $\mu$m.

27 Claims, 1 Drawing Sheet

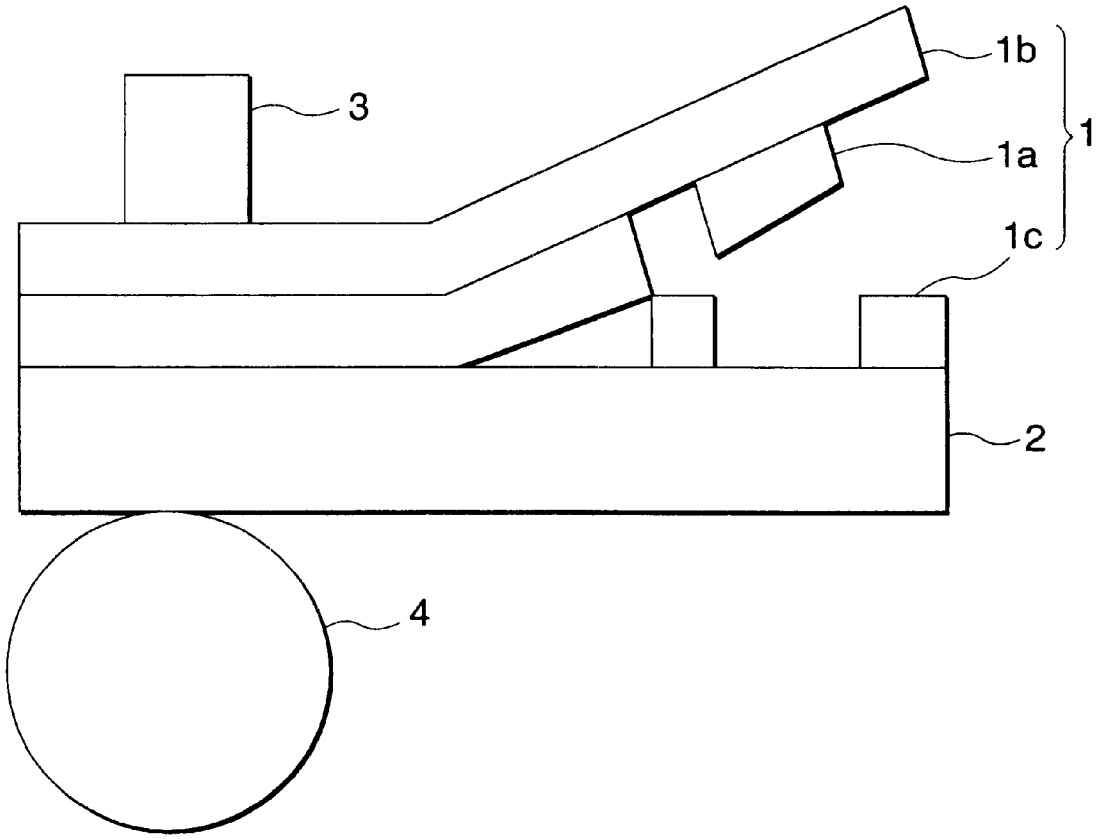
1b
3
1
1a
1c
2
4

IMAGE-RECEIVING FILM FOR PRINTING AND HEAT TRANSFER

BACKGROUND OF THE INVENTION

1. Field of the Invention

The present invention relates to a heat transfer film having excellent transferring properties and excellent adhesion of ink which gives clear images in a heat transfer printer. In particular, the present invention relates to a thermoplastic resin film which is a melt heat transfer film having excellent transferring property and excellent adhesion of ink in various printing systems.

2. Discussion of the Background

A variety of systems have been used for recording images and information, for example, a sublimation heat transfer system, a melt heat transfer system, an electrophotographic system and an electrostatic recording system. In these systems, a heat energy is used for the transfer, fixing and adhering of images. For example, a system is known wherein an ink ribbon is pressed onto a recording medium and a coloring material is transferred from the ink ribbon to the recording material. In another system, a toner is transferred to a recording medium and adhered to the recording medium by heating a high-temperature roll or light.

A melt heat transfer system which is generally used for information recording for example, for bar codes is explained in the following. As shown in FIG. 1, a heat-transfer ink ribbon 1 composed of a heat-melting ink la and a base material 1*b* for supporting the ink and an image-receiving film 2 are inserted between a printing head 3 equipped with a thermal head as a heat source and a drum 4. The thermal head is controlled using an electric signal and the heat melting ink 1*a* in the heat-transfer ink ribbon is heated. The molten ink is directly transferred to the image-receiving film 2. Ic denotes the transferred ink.

The support itself may be used as the image-receiving film in a melt heat transfer system. A layer of a polyester resin or an epoxy resin or a primer layer having good adhesion to a heat-melting ink is frequently formed on the surface of the support.

Examples for the support of the image-receiving film are a pulp paper, a synthetic paper made of a stretched film of a propylene resin containing an inorganic fine powder such as a burned clay or calcium carbonate a stretched film of polyethylene terephthalate; a polyolefin resin film; a coated synthetic paper, wherein the whiteness and the dyeing property are increased by coating a pigment coating agent containing an inorganic fine powder such as silica or calcium carbonate and a binder on the surface of the above-described film or paper.

A synthetic paper obtained by stretching a polyolefin-base resin film containing an inorganic fine powder and having many micro voids (fine pores) is preferred as support of any image-receiving film after transferring, based on its strength and dimensional stability (see Japanese Patent Publication No. 40794/1971, Japanese Patent Laid-Open Nos. 55433/1981, 149363/1982, and 181829/1982, and U.S. Pat. No. 3,765,999).

Good flexibility and heat resistance are obtained in the synthetic papers by forming micro voids inside the film. As a result thereof the cushion property towards a printing head is improved and it becomes possible to highly efficiently utilize the heat energy.

An image-receiving film supported by a stretched polyolefin resin film containing an inorganic fine powder, which is coated with a water-soluble primer of a nitrogen-containing high molecular compound for imparting various printing aptitudes and antistatic properties is described in Japanese Patent Laid-Open No. 149363/1982 and U.S. Pat. Nos. 4,420,536, 4,906,526, and 5,834,098. Such image-receiving-film is used for a melt heat-transfer system. However, the primer layer is hygroscopic and contains a large amount of water in a high temperature high-humidity environment. Accordingly, the following problems arise: the transfer of the heat-melting ink is disturbed and it is difficult to transfer the heat-melting ink onto an image-receiving film. As a result thereof, line cutting of prints, such as bar codes, occurs and the images become indistinct.

Japanese Patent Laid-Open No. 80684/1996 discloses that clear images can be obtained even in a high-temperature high-humidity environment This is achieved by using an image-receiving film obtained by coating a water-soluble primer of a nitrogen-containing high-molecular compound on a fine porous support. The fine-porous support is made of the stretched product of a polyolefin resin film containing from 30 to 65% by weight a colloidal calcium carbonate fine powder. The calcium carbonate fine powder has a mean particle size of from 0.02 to 0.5 $\mu$m and a specific area of from 60,000 to 300,000 $cm^2/g$.

However, the hygroscopicity of the primer layer is increased when using an image-receiving film having a support comprising a stretched polyolefin resin film and having a water-soluble primer of a nitrogen-containing high molecular compound in a high-temperature high-humidity environment for a long time. The primer layer becomes the transferring surface (printing surface) of the heat-melting ink. It is considered that the surface of the primer layer retains evaporated water.

The printed matter exhibits inferior ink adhesion when left in a high-temperature-high-humidity environment for a long time. When the printed surface is treated with a cellophane tape, the ink is easily released.

The present invention solves the above problems of the related art by providing a thermoplastic resin film having excellent printing properties.

SUMMARY OF THE INVENTION

It is an object of the present invention to provide a heat transfer film having excellent transferring properties and excellent adhesion of ink which gives clear images in a heat transfer printer.

It is another object of the present invention to provide a thermoplastic resin film which is a melt heat transfer film having excellent transferring properties and excellent adhesion of ink in various printing systems.

These and other objects have achieved by the present invention, the first embodiment of which includes an image-receiving film for printing and heat transfer, comprising:

a support comprising a thermoplastic resin film;, and a coated layer formed on said thermoplastic resin film;

wherein said coated layer comprises a component (A);

wherein said component (A) is an aqueous resin dispersion;

wherein said aqueous resin dispersion is obtained by dispersing an olefin copolymer (a) having an unsaturated carboxylic acid or an unsaturated carboxylic acid anhydride in water;

wherein said dispersing of said olefin copolymer (a) proceeds using at least one dispersing agent ()) selected from the group consisting of a nonionic surface active agent, a nonionic water-soluble high molecular compound, a cationic surface active agent, and a cationic water-soluble high molecular compound;

wherein a weight ratio of (a)/(b) is from 100/1 to 100/30 based on a total weight of solid components in said aqueous resin dispersion; and wherein said olefin copolymer (a) and said dispersing agent (b) each independently have a mean particle size of not more than 5 μm.

BRIEF DESCRIPTION OF THE DRAWING

FIG. 1 shows a cross section of the outline of a printing apparatus of a melting heat transfer system.

DETAILED DESCRIPTION OF THE INVENTION

The present invention provides for an image-receiving film for printing and heat transfer comprising a support having a coated layer. The coated layer is formed by coating and drying a component (A). (A) is an aqueous dispersion of a resin obtained by dispersing an olefin copolymer (a) having an unsaturated carboxylic acid or an unsaturated carboxylic acid anhydride in water. At least one dispersing agent (b) selected from a nonionic surface active agent, a nonionic water-soluble high molecular compound, a cationic surface active agent, and a cationic water-soluble high molecular compound is used for the dispersing of the olefin polymer (a). The weight ratio of (a)/(b) is from 100/1 to 100/30, based on the total weight of the solid components. The olefin copolymer (a) and the dispersing agent (b) each independently have a mean particle size of not larger than 5 μm.

The coated layer contains as component (B) a polyimine polymer or an ethyleneimine addition product of a polyamninepolyamide represented by formula (I):

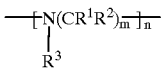

(I)

wherein $R^1$ and $R^2$ each independently represent a hydrogen atom, a straight chain or branched alkyl group having from 1 to 10 carbon atoms, an alkyl group having an alicyclic structure, or an aryl group;

$R^3$ represents a hydrogen atom, an ably group having from 1 to 20 carbon atoms, an allyl group, an alkyl group having an alicyclic structure; an aryl group, or the hydroxide thereof, m represents an integer of from 2 to 6; and n represents an integer of from 20 to 3000.

The coated layer can contain a single ethyleneimine addition product or a composite of several ethyleneimine addition products.

Furthermore, it is preferable that the coated layer contains a crosslinking agent (C) selected from a water-soluble epichiorohydrin addition product of an epoxy polyaminepolyamide, an isocyanate polyadiiepolyamide, a formalin polyaminepolyamide, or an oxazoline polyaminepolyamide.

In addition, a coated layer containing a formalin-type antistatic agent as a component (D) is furthermore preferable.

It is preferred that the support comprising a thermoplastic resin contains an inorganic fine powder and/or an organic filler. A particularly preferred inorganic fine powder is calcium carbonate having a particle size of from 0.1 to 15 μm. In addition, a stretched support is preferred.

[1] Coating Agent:

(1) Constituting Materials:

Component (A):

Due to the heat during printing the ink component of the heat-melting ink and the resin component of component (A) are further softened and welded. This results in strong adhesion of the coated layer to the heat-melting ink.

Component (A) comprises an olefin copolymer (a) having an unsaturated carboxylic acid or an unsaturated carboxylic acid anhydride. Preferred examples of an olefin copolymer having an unsaturated carboxylic acid or its anhydride are an ethylene (meth)acrylic acid copolymer, an alkali (alkaline earth) metal salt of an ethylene-(meth)acrylic acid copolymer, an ethylene(meth)acrylic acid ester-maleic anhydride copolymer, a (meth)acrylic acid graft polyethylene, a maleic anhydride graft polyethylene, a maleic anhydride graft ethylene-vinyl acetate copolymer, a maleic anhydride graft (meth)acrylic acid ester-ethylene copolymer, a maleic anhydride graft polypropylene, a maleic anhydride graft ethylene-propylene copolymer, a maleic anhydride graft ethylene-propylene-butene copolymer and a maleic anhydride graft ethylene-butene copolymer; a maleic anhydride graft propylene-butene copolymer.

Based on their ink-receiving property, particularly preferred examples of olefin copolymers are the ethylene-(meth)acrylic acid copolymer, the ethylene-(meth)acrylic acid ester-maleic anhydride copolymer, the maleic anhydride graft ethylene-vinyl acetate copolymer, the maleic anhydride graft (meth)acrylic acid ester-ethylene copolymer, the maleic, anhydride graft ethylene-propylene-butene copolymer, the maleic anhydride graft ethylene-butene copolymer, and the maleic anhydride graft propylene-butene copolymer, each having a melting point or softening point of not more than 130° C.

Preferred dispersing agents (b) are a nonionic surface active agent, a nonionic water-soluble high molecular compound, a cationic surface active agent, and a cationic water-soluble high molecular compound.

Preferred examples of nonionic surface active agents include a polyoxyethylene alkyl ether, a polyoxyethylene alkylallyl ether, a polyoxyethyleneoxypropylene block polymer, a polyoxyethylene glycol fatty acid ester, and a polyoxyethylenesorbitan fatty acid ester.

Preferred examples of the nonionic water-soluble high molecular compounds include completely saponified polyvinyl alcohol, partially saponified polyvinyl alcohol and their denatured products, as well as hydroxy cellulose.

Preferred examples of the cationic surface active agent include stearylamine hydrochloride, lauryltrimethylammonium chloride, and trimethyloctadecylammonium chloride.

Furthermore, preferred examples of the cationic water-soluble high molecular compounds include polymers having a quaternary ammonium salt structure or a phosphonium salt structure, a nitrogen-containing (meth)acryl polymer, and a nitrogen-containing (meth)acryl polymer having a quaternary ammonium salt structure.

Particularly preferred are the nitrogen-containing (meth) acryl polymer or the nitrogen-containing (meth)acryl polymer having a quaternary ammonium salt structure based on their excellent adhesion to a thermoplastic resin film.

To disperse the olefin copolymer (a) in water using the dispersing agent (b), it is preferred that the weight ratio of (a)/(b) is from 100/1 to 100/30 based on the total weight of the solid components. The ratio (a)/(b) includes all values and subvalues therebetween, especially including 100/5; 100/10; 100/15; 100/20 and 100/25. If a smaller amount of dispersing agent is used, the olefin copolymer (a) cannot be dispersed in water. On the other hand, if the amount of dispersing agent exceeds the above range, it is difficult to improve the inferior adhesion of an ink in an high-temperature-high-humidity environment.

It is preferred that the mean particle size of the resin particles in component (A) is independently not larger than 5 μm, If the mean particle size exceeds 5 μm, the stationary stability of the aqueous dispersion becomes inferior and the adhesion to the support of the thermoplastic resin film is diminished.

Several methods are preferred for dispersing the olefin copolymer (a) in water using the dispersing agent (b), for example, (1) dissolving the olefin copolymer in an aromatic hydrocarbon solvent by heating, mixing the dispersing agent (b) with the solution by stirring, adding water, distilling off the aromatic hydrocarbon solvent to obtain an aqueous dispersion; or (2) supplying the olefin copolymer to the hopper of a twin-screw extrudes, adding an aqueous solution of the dispersing agent (b) which has been molten by heating followed by melt kneading, and adding water to obtain an aqueous dispersion as shown in Japanese Patent Publication No. 29447/1987. Particularly preferred is a dispersing agent (b) which is a cationic water-soluble high molecular compounds such as the nitrogen containing (meth)acryl polymer or the nitrogen containing (et)acryl polymer having a quaternary ammonium salt structure. The use of a twin-screw extruder is preferred due to the mean particle size of the resin particles in the resulting aqueous dispersion.

Component (B):

The adhesion of a printing ink and particularly the adhesion of a UV-curable ink can be improved by adding a polyimine polymer or the ethyleneimine addition product of a polyaminepolyamide as component (B) to component (A). Preferred ethyleneimine addition products are polyethyleneimine, poly(ethyleneimine-urea) and the ethyleneimine addition products of polyaminepolyamide or their alkyl-modified products, their cycloalkyl-modified products, their aryl-modified products, their aralkyl-modified products, their alkylaryl-modified product, their benzyl-modified products, their cyclopentyl-modified products, and their alicyclic hydrocarbon-modified products, and their hydroxides. They can be used singly or as a mixture.

In these compounds, it is preferred to use the polyimine polymer of formula (I) from the view point of improving the adhesion and the transferring property of an offset ink:

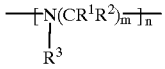

(I)

wherein $R^1$ and $R^2$ each independently represent a hydrogen atom, a straight chain or branched alkyl group having from 1 to 10 carbon atoms, an alkyl group having an alicyclic structure, or an aryl group;

$R^3$ represents a hydrogen atom, an alkyl group having from 1 to 20 carbon atoms, an allyl group, an aryl group having an alicyclic structure, an aryl group, or the hydroxide thereof;

m represents an integer of from 2 to 6; and n represents an integer of from 20 to 3000.

The polymerization degree of the polyethyleneimine is not particularly limited. However, a polymerization degree of from 20 to 3,000 is preferred. The polymerization degree includes all values and subvalues therebetween, especially including 100, 200, 300, 400, 500, 600, 700, 800, 900, 1000, 1100, 1200, 1300, 1400, 1500, 1600, 1700, 1800, 1900, 2000, 2100, 2200, 2300, 2400, 2500, 2600, 2700, 2800 and 2900.

A single polyimine polymer can be used or a composite of several polyimine polymers can be used.

Component (C):

The water resistant adhesion of a printing ink is improved by adding a water-soluble crosslinking agent as component (C) to components (A) and (B). A crosslinking agent is selected from an epoxy resin, an isocyanate resin, a formalin resin or an oxazoline resin. Preferred crosslinking agents are bisphenol A-epichlorohydrin resin, an aliphatic epoxy resin, an epoxynovolac resin, an alicyclic novolac resin and a brominated epoxy resin. Most preferred are an epichlorohydrin addition product of polyaminepolyamide, a monofunctional or multifunctional glycidylether, and glycidyl esters.

Component (D);

Attaching of dust and electrostatic charging during printing can be reduced by adding a polymeric antistatic agent as component (D) to components (A) and (B). Preferred polymeric antistatic agents are cationic, anionic, amphoteric and nonionic antistatic agents. Preferred cationic antistatic agents have an ammonium salt structure or a phosphonium salt structure. Preferred anionic antistatic agent are, for example, antistatic agents each having an alkali metal salt structure of acrylic acid (e.g., lithium salt, sodium salt, and potassium salt), methacrylic acid or maleic acid or its anhydride.

Preferred amphoteric antistatic agents have both a cationic and an anionic structure in the same molecule, for example, betaine antistatic agents, Preferred nonionic antistatic agents are an ethylene oxide polymer having an ethylene oxide structure and a polymer having an ethylene oxide polymer component in the molecular chain. Another preferred example is a polymeric antistatic agent having boron in the molecular structure. Among the polymeric antistatic agents, a nitrogen-containing polymeric antistatic agent is preferred, and an acrylic polymer containing tertiary nitrogen or quaternary nitrogen is more preferred.

In addition, the coating agent of the invention may contain, if necessary, a defoaming agent and other additives, in an amount that does not reduce the printing and heat transferring characteristics.

(2) Content Ratio:

The coating agent according to the invention contains components (B) to (D) in the following amounts based on 100 pats by weight of component (A):

Component (B) from 1 to 25 parts by weight, preferably from 2 to 15 parts by weight;

Component (C) from 0 to 25 parts by weight, preferably from 2 to 15 parts by weight;

Component (D) from 0 to 25 parts by weight, preferably from 2 to 15 parts by weight;

(3) Form of the Coating Agent:

Each component of the above-described coating agent can be used in form of a solution in a solvent such as water, methyl alcohol, ethyl alcohol, isopropyl alcohol, acetone, methyl ethyl ketone, ethyl acetate, toluene and xylene. Aqueous solutions of the components ((A) only, (A)+(B), (A)+(B)+(C), (A)+(B)+(D) or (A)+(B)+(C)+(D)) of the coating agent are preferred. The solution concentration is preferably from 0.5 to 40% by weight, and more preferably from 1 to 20% by weight. The solution concentration includes all values and subvalues therebetween, especially including 1, 5, 10, 15, 20, 25, 30 and 35% by weight.

(4) Coating:

(a) Coating Amount:

The amount of coating agent that is coated onto a support is from 0.03 to 5 g/m$^2$, and preferably from 0.05 to 0.5 g/m$^2$. The a-mount of coating agent includes all values and subvalues therebetween, especially including 0.05, 0.1, 0.5, 1, 1.5, 2, 2.5, 3, 3.5, 4 and 4.5 g/M$^2$. If the amount of coating agent is less than 0.03 g/m$^2$, the transferring property, the adhesion, and the water resistant adhesion of the heat-melting ink in a high-temperature-high-humidity environment are insufficient. If the amount of coating agent exceeds 5 g/m$^2$, the drying property is inferior. Further, since sufficient performance is obtained using an amount of coating agent of 5 g/m$^2$, excessive amounts increase costs and are unsuitable for practical use.

(b) Coating Apparatus:

A coating apparatus utilizing a roll coater, a blade coater, an air knife coater, a size press coater, a gravure coater, a die coater, a lip coater and a spray coater can be used.

[2] Support:

A thermoplastic resin film is used as support in the present invention. The support be a laminate of a pulp-made paper and a plain weave cloth (pongee) or a non-woven fabric (spun pongee).

There is no particular restriction on the kind of thermoplastic resin film used in the invention. Preferred thermoplastic resin films are, for example, ethylene resins such as high-density polyethylene, intermediate-density polyethylene; polypyrene resins; polyolefin resins such as polymethyl-1-pentene and an ethylene-cyclic olefin copolymer, polyamide resins such as nylon-6 and nylon-6,6; thermoplastic polyester resins such as polyethylene terephthalate and the copolymer thereof and polybutylene terephthalate and the copolymer thereof an aliphatic polyester; polycarbonate; atactic polystyrene; and syndiotactic polystyrene. Nonpolar polyolefin resins are more preferably used.

Furthermore, from the view point of the chemical resistance and cost, a propylene resin is preferably used as polyolefin resin. The propylene resin can be an isotactic polymer obtained by homopolymerizing propylene or it can be a syndiotactic polymer. Furthermore, copolymers having polypropylene as the main constituent and having various stereoregularities each obtained by copolymerizing propylene and an α-olefin such as ethylene, 1-butene, 1-hexene, 1-heptene and 4-methyl-4-pentene can be used. The copolymer can be a bipolymer, a terpolymer, or a multi-polymer. The copolymer can be a random copolymer or a block copolymer. If a propylene homopolymer is used, it is preferred that the homopolymer is used in a composite with 2 to 25% by weight of a resin having a lower melting point than the propylene homopolymer. Preferred resins having a lower melting point are high-density and low-density polyethylenes. One of the above-described thermoplastic resins may be used singly or a combination of two or more resins can be used.

The thermoplastic resin can contain an inorganic fine powder and/or an organic filler.

The mean particle size of the inorganic fine powder is preferably from 0.01 to 15 μm, more preferably from 0.1 to 10 μm, and most preferably from 0.5 to 5 μm. The mean particle size includes all values and subvalues therebetween, especially including 0.05, 0.1, 0.5, 1, 2, 3, 4, 5, 6 7, 8, 9, 10, 11, 12, 13 and 14 μm. If the mean particle size is smaller then 0.01 μm, the inorganic fine powder may not be uniformly dispersed during melt kneading with the thermoplastic resin. The inorganic fine resin powder causes a secondary aggregation, and the resin powder causes water bubbling due to adsorbed water. If the mean particle size exceeds 15 μm, the strength of the film will be lowered. Preferably, calcium carbonate, a burned clay, silica, diatomaceous earth, clay, titanium oxide, barium sulfate and alumina are used as inorganic fine powder. Calcium carbonate is preferred.

The particle sizes of the inorganic fine powder were measured by the particle sizes (cumulative 50% particle size) corresponding to 50% of the cumulative value measured by a particle measurement apparatus, and a laser diffraction particle measurement apparatus "Microtruck" (trade name, manufactured by Nikiki Sosha K. K.).

An organic filler having a mean particle size after dispersing of from 0.01 to 15 μm, preferably from 0.01 to 8 μm, and more preferably from 0.03 to 4 μm can be used. The mean particle size includes all values and subvalues therebetween, especially including 0.05, 0.1, 0.5, 1, 2, 3, 4, 5, 6 7, 9, 10, 11, 12, 13 and 14 μm. It is preferred to select a resin different from the thermoplastic resin which is the main constituent in the invention. For example, if the thermoplastic resin film is a polyolefin resin film, then an organic filler, such as polyethylene terephthalate, polybutylene terephthalate, polycarbonate, nylon-6, nylon-6,6, a homopolymer of a cyclic olefin, a copolymer of a cyclic olefin and ethylene, each having a melting point of from 120 to 300° C. or a glass transition temperature of from 120 to 280° C. is preferably used.

A stabilizer, a light stabilizer, a dispersing agent and a lubricant can be added to the thermoplastic resin in addition to the inorganic fine powder and/or the organic filler.

The stabilizer is preferably added in an amount of from 0.001 to 1% by weight. The amount includes all values and subvalues therebetween, especially including 0.005, 0.01, 0.05, 0.1, 0.5 and 0.9% by weight. Preferably, a sterically hindered phenol stabilizer, a phosphorus stabilizer or an amine stabilizer are used.

The light stabilizer is preferably added in an amount of from 0.001 to 1% by weight. The amount includes all values and subvalues therebetween, especially including 0.005, 0.01, 0.05, 0.1, 0.5 and 0.9% by weight. Preferably, a sterically hindered amine, a benzotriazole or a benzophenone are used as light stabilizer.

A dispersing agent and a lubricant are used for the purpose of dispersing, for example, the inorganic fine powder. The amount of dispersing agent is preferably in the range of from 0.01 to 4% by weight. The amount includes all values and subvalues therebetween, especially including 0.05, 0.1, 0.5, 0.9, 1, 1.5, 2, 2.5, 3 and 3.5% by weight. Preferably, a silane coupling agent; higher fatty acids such as oleic acid and stearic acid; metal soaps; polyacrylic acid, polymeric acid, and the salts thereof are used.

There is no particular restriction on the forming method of the support made of the thermoplastic resin film. The support can be formed by selecting a proper method from various known methods. For example, the support can be formed by using a method of cast molding, by extruding the molten resin to a sheet using a T die or U die of a single layer or laminated layers connected to a screw-type extruder, calender molding, rolling molding, inflation molding, after cast molding or calender molding a mixture of the thermoplastic resin and a solvent or an oil followed by removing the solvent or the oil.

The thermoplastic resin film used for the support can be an unstretched film or a stretched film. Stretching can be carried out using the following methods: longitudinal stretching utilizing the peripheral speed difference of roll group, lateral stretching using tenter ovens, simultaneous biaxial stretching by a combination of tenter ovens and a linear motor.

Stretching can be carried out in a temperature range suitable for the thermoplastic resin, for example, at a temperature of at least the glass transition temperature of the thermoplastic resin when using a non-crystal resin, or at a temperature between the glass transition temperature and the melting temperature of the non-crystal portion and the crystal portion of a resin. The stretching temperature is preferably a temperature of from 2 to 60EC lower than the melting point of the thermoplastic resin. If the resin is a propylene homopolymer (melting point 155 to 167° C.), the stretching temperature is preferably from 152 to 164° C. If the resin is high-density polyethylene (melting point 121 to 134° C.), the stretching temperature is preferably from 110 to 120° C. If the resin is polyethylene terephthalate (melting point 246 to 252° C.), the stretching temperature is preferably from 104 to 115° C. The stretching rate is preferably from 20 to 350 m/min. The stretching rate includes all values and subvalues therebetween, especially including 50, 100, 150, 200, 250 and 300 m/min.

The stretching ratio is not limited. It is properly determined by considering the characteristics of the thermoplastic resin. The stretching ratio for stretching in one direction is from about 1.2 to 12 times, and preferably from 2 to 10 times, based on the area ratio if a propylene homopolymer or the copolymer thereof is used as the thermoplastic resin. The stretching ratio for biaxial stretching is from 1.5 to 60 times, and preferably from 10 to 50 times based on the area ratio.

If another thermoplastic resin is used, the stretching ratio for stretching in one direction of from 1.2 to 10 times, and preferably from 2 to 5 times. The stretching ratio for biaxial stretching is from 1.5 to 20 times, and preferably from 4 to 12 times based on the area ratio.

A porous resin stretched film having fine inner voids can be obtained when the thermoplastic resin containing the inorganic fine powder or the organic filler is stretched.

The void ratio of the fine voids is shown by the following equation (1);

$$\text{Void Ratio } (\%)=(\rho_0-\rho)/\rho_0\times 100 \quad (1)$$

In equation (1), pa represents the true density of a stretched film and p represents the density (JIS-P-8118) of the stretched film. If the material before stretching does not contain a large amount of air, then the true density is almost the same as that of the film before stretching.

The void ratio is in the range of from 5 to 60%, and preferably from 10 to 59%. The void ratio includes all values and subvalues therebetween, especially including 10, 15, 20, 25, 30, 35, 40, 45, 50 and 55%.

The density of the stretched thermoplastic resin film is from 0.65 to 1.20 g/cm$^2$. The opacity of the stretched thermoplastic resin film (JIS-P-8138) is from 50 to 100%, and preferably from 70 to 100%. The whiteness (JIS-0-8125) of the stretched thermoplastic resin film is from 80 to 100% and preferably from 90 to 100%.

The thermoplastic resin film forming the support of the invention may be a single layer, a two-layer structure consisting of a base layer and a surface layer, a three-layer structure consisting of a base layer having a layer on the front surface and back surface, or a multilayer structure having other resin film layer(s) between the base layer and the surface layer. The film can be stretched in at lea one direction. When the multilayer structure film is stretched, the stretching axis number can be, in the case of the three-layer structure, uniaxial/uniaxial/uniaxial, uniaxial/uniaxial/biaxial, uniaxial/biaxial/uniaxial, biaxial/uniaxial/uniaxial, uniaxial/biaxial/biaxial/, biaxial/biaxial/uniaxial/, or biaxial/biaxial/biaxial. In the case of multilayer structure having more than three layers, the stretching axis number can be optionally combined.

If the thermoplastic resin film is a single layer and contains the inorganic fine powder and/or the organic filler, the film is preferably composed of from 40 to 99.5% by weight the polyolefin resin and from 60 to 0.5% by weight the inorganic fine powder and/or the organic filler. The polyolefin resin film is more preferably composed of from 50 to 97% by weight of the polyolefin resin and of from 50 to 3% by weight of the inorganic fine powder and/or the organic filler. If the thermoplastic resin film is a multilayer structure and the base layer and the surface layer contain the inorganic fine powder and/or the organic filler, then the base material layer is preferably composed of from 40 to 99.5% by weight of the polyolefin resin and of from 60 to 0.5% by weight of the inorganic fine powder and/or the organic filler, and the surface layer is composed of from 25 to 100% by weight of the polyolefin resin and of from 75 to 0% by weight of the inorganic fine powder and/or the organic filler. The base layer is more preferably composed of from 50 to 97% by weight of the polyolefin resin and of from 50 to 3% by weight of the inorganic fine powder and/or the organic filler. The surface layer is more preferably composed of from 30 to 97% by weight of the polyolefin resin and of from 70 to 3% by weight of the inorganic fine powder and/or the organic filler.

The stretched resin film will break during lateral stretching carried out after longitudinal stretching, if the inorganic fine powder and/or the organic filler contained in the single layer structure or in the base layer of the multilayer structure exceeds 60% by weight. If the content of the inorganic fine powder and/or the organic filler containing the surface layer exceeds 75% by weight, the surface strength of the surface layer after lateral stretching is low and the surface layer will break by a mechanical impact or during use, which is undesirable.

The thickness of the support used in the invention is preferably in the range of from 20 to 350 $\mu$m, and more preferably in the range of from 35 to 300 $\mu$m. The thickness includes all values and subvalues therebetween, especially including 50, 100, 150, 200, 250 and 300 $\mu$m.

A surface oxidation treatment is applied to the surface of the support before forming the coating layer on the surface. Preferred surface oxidation treatments are corona discharging treatment, a flame treatment, a plasma treatment, a glow discharging treatment and an ozone treatment. A single treatment or a combination of various surface oxidation treatments can be applied to the surface of the support. Corona discharging treatment and flame treatment are preferred. The treatment energy for corona discharging treatment is from 600 to 12,000 J/m$^2$ (10 to 200 WAminute/m$^2$), and preferably from 1,200 to 9,000 J/m$^2$ (20 to 180 WAminute/m$^2$). The treatment energy for flame treatment is from 8,000 to 200,000 J/m$^2$, and preferably from 20,000 to 100,000 J/m$^2$.

[3] Uses:

The image-receiving film for printing and heat transfer according to the present invention can be used for recording in various heat transfer systems such as a sublimation heat transfer system, a melt heat transfer system, an electrophotographic system and an electrostatic recording system. The use for the melt heat transfer system is preferred because the adhesion of the printed or transferred image portion is excellent when placed in a high-temperature-high-humidity environment for a long time.

Preferred ink ribbons are a wax ink ribbon, a resin ink ribbon, and their combinations.

Moreover, preferred printing methods are letterpress printing, offset printing, gravure printing, and flexographic printing.

Having generally described this invention, a further understanding can be obtained by reference to certain specific examples which are provided herein for purposes of illustration only, and are not intended to be limiting unless otherwise specified.

EXAMPLES (A) Production Examples of the Components:

(1) Synthesis Example of a Cationic Water-Soluble Methacrylic Resin as the Dispersing Agent (b):

A mixture of 62.9 parts of N,N-dimethylaminoethyl methacrylate, 71 parts of butyl methacrylate, 25.4 parts of lauryl methacrylate, and 200 parts of isopropyl alcohol was placed in a four-neck flask equipped with a stirrer, a reflux condenser, a thermometer, and a dropping funnel. After replacing the inside atmosphere of the flask with nitrogen gas, 0.9 parts of 2,2'-azobisisobutyronitrile were added as a polymerization initiator to carry out the polymerization reaction for 4 hours at 80° C. Then, after neutralizing with 24 parts of acetic acid, while distilling off isopropyl alcohol, water was added to finally obtain a viscous aqueous solution (b) of the dispersing agent having 35% solid components.

(2) Production Method of Component (A):

An ethylene-methacrylic acid copolymer (methacrylic acid content 10% by weight, MFR 35 g/10 minutes) (a) was continuously supplied to a same-direction intermeshing type twin-screw extruder "PCM 45 ϕ" (trade name, manufactured by Ikegai Sha K. K.) at a ratio of 100 parts/hour. The above-described aqueous solution of the dispersion (b) was continuously supplied to the extruder from a 1st inlet of the extruder at a ratio of 22.9 parts/hour (8 parts/hour for the solid component of the dispersing agent), and while continuously supplying water from a second inlet of the elder at a ratio of 70 parts/hour, the mixture was continuously extruded at a heating temperature (cylinder temperature) of 130° C. to obtain a milk-white aqueous resin dispersion. After filtering the aqueous resin dispersion with a stainless steel wire gauze of 250 mesh, water was added such that the solid components became 45%.

When the mean particle size of the aqueous resin dispersion was measured by a laser particle size distribution measurement apparatus, SALD-2000 manufactured by SHIMADZU CORPORATION, the mean particle size was 0.74 μm.

Production Example of Component (B):

(B-1) Glycidol-Modified Polyimine-Base Polymer:

100 Parts of an aqueous solution of 25% by weight of polyethyleneimine "Epomin P-1000 (polymerization degree 1600)" (trade name, manufactured by NIPPON SHOKUBAICO., LTD.), 10 parts of glycidol, and 10 parts of propylene glycol monomethyl ether were placed in a four-neck flask equipped with a stirrer, a reflux condenser, a thermometer and a nitrogen gas inlet followed by stirring under a nitrogen gas stream. A modification reaction was carried out at 80° C. for 16 hours to obtain an aqueous solution of glycidol-modified polyethyleneimine. After drying the product was investigated by infrared analysis, $^{1}$H-nuclear magnetic resonance analysis ($^{1}$H—NMR) and $^{13}$C-nuclear magnetic resonance analysis ($^{13}$C—NMR). It has been coded that the product ha a structure formed by adding an epoxy group of glycidol to the nitrogen of polyethyleneimine and is the product obtained by reacting 23% of the nitrogen of polyethyleneimine and glycidol.

(B-2) Butyl-Modified Polyimine-Base Polymer:

100 parts of an aqueous solution of 25% by weight polyethyleneimine "Epomin P-1000 (polymerization degree 1600)" (trade name, manufactured by NIPPON SHOKUBAI CO., LTD.), 10 parts of n-butyl chloride, and 10 parts of propylene glycol monomethyl ether were placed in a four-neck flask equipped with a stirrer, a reflux condenser, a thermometer, and a nitroge gas inlet followed by stirring under a nitrogen gas stream. A modification reaction was carried out at 80° C. for 20 hours to obtain an aqueous solution of 20% by weight of butyl-modified polyethyleneimine.

Component (C):

The epichlorohydrin addition product of polyamninepolyamide "WS-570 (solid components 12.5% by weight)" (trade name, manufactured by Nippon PMC K. K.) was used.

Production Example of Component (D):

35 Parts of dimethylaminoethyl methacrylate, 20 parts of ethyl methacrylate, 20 parts of cyclohexyl methacrylate, 25 parts of stearyl methacrylate, 150 parts of ethyl alcohol, and 1 part of azobisisobutyronitrile were placed in a four-neck flask equipped with a reflux condenser, a glass pipe for replacing with nitrogen, and a stirrer. The polymerization reaction was carried out at 80° C. for 6 hour under a nitrogen gas stream.

Then, 70 parts of an ethyl alcohol solution of 60% by weight of 3chloro-2-hydroxypropylammonium chloride were added to the reaction mixture and after further reacting at 80° C. for 15 hours, ethyl alcohol was distilled off while adding water dropwise to obtain a final quaternary ammonium salt-type copolymer having 30% of solid components.

The copolymer is an acrylic acid alkyl ester polymer containing the following group in the molecular chain.

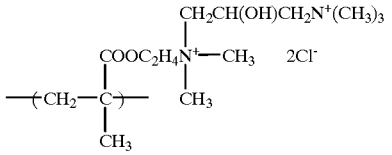

Production Example 1 of Support:

(1) After kneading a composition (A) obtained by mixing 81% by weight of a propylene homopolymer (melting point 164° C.) having a melt flow rate (MFR) of 0.8 g/10 minutes with 3 parts by weight of high-density polyethylene and 16% by weight heavy calcium carbonate having a mean particle size of 1.5 μm using an extruder held at 270° C., the kneaded mixture was extruded to a sheet form, and further cooled by a cooling apparatus to obtain a non-stretched sheet. Then, after re-heating the sheet to a temperature of 150° C., the sheet was stretched 5 times in the longitudinal direction to obtain a 5-times longitudinally stretched resin film.

(2) After kneading a composition (B) obtained by mixing 55% by weight of a propylene homopolymer (melting point 164EC) having a MER of 4 g/10 minutes and 45% by weight heavy calcium carbonate having a mean particle size of 1.5

μm using another extruder held at a temperature of 270° C., the kneaded mixture was exuded to a sheet form, and the sheet was laminated on both surfaces of the 5-times longitudinally stretched film to obtain a laminated film having a three-layer structure. Then, after cooling the laminated film having the three layer structure to a temperature of 60° C., the film was heated again to 155° C., stretched 7.5 times in the lateral direction using a tenter and subjected to an annealing treatment at a temperature of 165° C. After cooling to 60° C., the film was trimmed by slitting to obtain a laminated stretched film having a tree-layer structure (uniaxial stretching/biaxial stretching/uniaxial stretching) having a thickness of 80 μm (B/A/B=15 μm/50 μm/15 μm), a density (p) of 0.79 g/cm$^2$, a void ratio of 29%, an opacity of 90% and a whiteness of 95%.

(3) The surface of the film was subjected to a corona discharging treatment using a corona discharging treatment "HF 400F" (trade-name, manufactured by Kasuga Denki K. K.) and using an aluminum electrode having a length of 0.8 m and a silicone-coated roll as a treater roll, at a gap between the electrode and the roll of 5 mm, a line treatment rate of 15 m/minute, and an applied energy density of 4,200 J/m$^2$.) having MFR of 4 g/10 minutes and 4596 by weight heavy calcium carbonate having a mean particle size of 1.5 μm were extruded by one main extrude and two sub extruders, and they were joined and extruded from on T die head, a laminated film of a sheet-form three-layer structure made of three layers obtained was cooled to 60° C. by a cooling apparatus, after heating again the film to a temperature of 150° C., the film was stretched 5 times to the longitudinal direction, and then subjected to an annealing treatment at 155° C. to obtain a laminated Production Example 2 of Support:

(1) A resin composition obtained by melt kneading a composition (A) using an extruder held at 270° C., wherein a composition (A) was obtained by mixing 81 parts by weight of a propylene homopolymer (melting point 164° C.) having a MFR of 0.8 g/10 minutes, 3 parts by weight of high-density polyethylene, and 16% by weight heavy calcium carbonate having a mean particle size of 1.5 μm, and a resin composition obtained by melt kneading a composition (B) using an extruder held at 270° C., wherein composition (B) was obtained by mixing 55% by weight a propylene homopolymer (melting point 164° C.) having a MFR of 4 g/10 minutes, and 45% by weight heavy calcium carbonate having a mean particle size of 1.5 μm were extruded by one main extruder and two sub extruders, and they were joined and extruded from a T die head. A laminated film of a sheet-form the layer structure was cooled to 60° C. by a cooling apparatus. After heating the film to a temperature of 150° C., the film was stretched 5 times in the longitudinal direction and then subjected to an annealing treatment at 155° C. to obtain a laminated stretched resin film having a thickness of 80 μm (B/A/B=20 μm/40 μm/20 μm), a density (ρ) of 1.00 g/cm$^3$, a void ratio of 15%, an opacity of 89% and a whiteness of 93%.

(2) Then, after cooling the laminated film of the three-layer structure to 60° C. by (2) The surface of the film was subjected to a corona discharging treatment using a corona discharging treatment "HF 400F" (trade name, manufactured by Kasuga Denki K. K.) and using an aluminum electrode having a length of 0.8 m and a silicone-coated roll as a treater roll, at a gap between the electrode and the roll of 5 mm, a line treatment rate of 15 m/minute, and an applied energy density of 4,200 J/m$^2$.

Production Example 3 1 of Support:

(1) A resin composition obtained by melt kneading a composition (A) using an extruder held at 270° C., wherein composition (A) was obtained by mixing 81 parts by weight of a propylene homopolymer (melting point 164° C.) having a MFR of 0.8 g/10 minutes, 3 parts by weight of high density polyethylene, and 16% by weight heavy calcium carbonate having a mean particle size of 1.5 μm, and a resin composition obtained by melt kneading a composition (B) using an extruder held at 270° C., wherein composition (B) was obtained by mixing 55% by weight a propylene homopolymer melting point 164° C.) having a MFR of 4 g/10 minutes and 45% by weight heavy calcium carbonate having a mean particle size of 1.5 μm were extruded by one main extruder and two sub extruders, and they were joined and extruded from a T die head to obtain a laminated film having a three-layer structure.

(2) Then, after cooling the laminated film having the three-layer structure to 60° C. by a cooling apparatus, the film was heated again to a temperature of 150° C. and stretched 5 times in the longitudinal direction. After further heating to a temperature of 155° C., a bar code printer "B-30-S5" (trade name, manufactured by TEC K. K.) and a melt-type resin-made ink ribbon "B110C" (trade name, manufactured by Ricoh Company, Ltd.) were used.

Evaluation of Ink Transferring Property

Using the above-described printer and ink ribbon, printing (CODE 39) of bar code was applied on the coated surface of the film was stretched 7.5 times in the lateral direction using a tenter and subjected to an annealing treatment at a temperature of 165° C. After cooling to a temperature of 60° C., the film was trimmed by slitting to obtain a laminated stretched resin film having a three-layer structure and a thickness of 80 μm (B/A/B=10 μm/60 μm/10 μm), a density (ρ) of 0.70 g/cm$^3$, a void ratio of 41%, an opacity of 92% and a whiteness of 96%.

(3) The surface of the film was subjected to a corona discharging treatment using a corona discharging treatment "HF 400F" (trade name, manufactured by Kasuga Denki K. K.) and using an aluminum electrode having a length of 0.8 m and a silicone-coated roll as a treater roll, at a gap between the electrode and the roll of 5 mm, a line treatment rate of 15 m/minute, and an applied energy density of 4,200 J/m$^2$.

Example 1

A coating agent made of the component (A) was coated on both surfaces of the support made of the laminated stretched resin film obtained in Production example 1 of support using a roll coater and dried to a dry thickness of the coated layer of 0.06 g/m$^2$ to obtain a film.

Evaluation

The melt heat transfer aptitude, the printability, and the antistatic property were evaluated as follows.

(1) Melt Heat Transfer Aptitude:

For printing, a bar code printer "B-30-S5" (trade name, manufactured by TEC K. K.) and a melt-type resin ink ribbon "B110C" (trade name, manufactured by Ricoh Company, Ltd.) were used.

Evaluation of Ink Transferring Property

Using the above-described printer and ink ribbon, a bar code was (CODE 39) applied on the coated surface of the film at a temperature of 35° C. and a relative humidity of 85%. The ink transferring property was evaluated by measuring ANSI GRADE (according to the printed level of the bar code). The evaluation results are shown by 7 grades of A to F. N/G) by a bar code inspection machine "LASER-CHEK 11" (Trade name, manufactured by Fuji Denki Reitoki K. K.) in the following evaluation standards.

A, B: Good (clear image is obtained)

C: Passable (slight thin spots seen in the bar code but keeps practical use)

D to F: Bad (line cut occurs at the bar code)

N/G: Bad (the level of not recognizing as the bar code of CODE 39)

Ink Adhesion Evaluation

Using the above-described printer and ink ribbon, a bar code (CODE 39) was applied on the coated surface of the film at a temperature of 23° C. and a relative humidity of 50%. After controlling the state of the printed material for at least 2 hours under the conditions of a temperature of 35° C. and a relative humidity of 85%, a cellophane tape was attached to the printed surface, and after sufficiently adhering the tape, the cellophane tape was slowly released and ANTI GRADE was measured by the bar code inspection machine, whereby the ink adhesion was evaluated by the following evaluation standards.

A, B: Good (clear image is obtained)

C: Passable (slight thin spots seen in the bar code but keeps practical use)

D to F: Bad (line cut occurs at the bar code)

N/G: Bad (the level of not recognizing as the bar code of CODE 39)

(2) Printability:

For the evaluation, a printing machine "RI-III Type Printability Test Machine" (trade name, manufactured by Akira Seisakusho K. K) and printing ink "Best Cure 161 (black); (trade name, manufactured by T & K TOKA K. K.) were used.

Ink Transferring Property

After storing the film for 3 days under an atmosphere having a temperature of 23° C. and a relative humidity of 50%, the above-described ink was printed on the coated surface of the film by the above-described printing machine such that the thickness became 1.5 g/m$^2$. The Macbeth density of the printed surface was measured by alight reflection densitometer "Macbeth Densitometer" (trade name, manufactured by Cormorgen Co. (U.S.A.)). The case where the Macbeth density was at least 1.4 was defined to be "pass".

Ink Adhesion

After storing the film for 3 days under an atmosphere having a temperature of 23° C. and a relative humidity of 50%, the above-described ink was printed on the coated surface of the film by the above-described printing machine such that the thickness became 1.5 g/m$^2$. After passing the film once under a metal halide lamp (80 W/cm) manufactured by Ai Graphic K. K. in an interval of 10 cm at a speed of 10 m/minute, the adhesive strength was measured by an adhesive strength measuring machine "Internal Bond Tester" (trade name, manufactured by Kumagaya Riken Kogyo K. K.). The case where the adhesive strength was at least 1.3 kg-cm was defined to be "pass".

The measurement principle of the above-described adhesive strength was as follows. An aluminum angle was attached to the upper surface of a sample having a cellophane tape attached to the printed surface of the film. The lower surface was similarly set to a definite holder. A hammer was swung down onto it at an angle of 90 degree to give an impact to the aluminum angle, and the releasing energy at the case was measured.

(3) Antistatic Property:

After controlling the state of the film for at least 2 hours under an atmosphere having a temperature of 23° C. and a relative humidity of 50%, the coated surface of the film was measured by an insulating meter "DSM-8103" (trade name, manufactured by Tooa Denpa Kogyo K. K.). A sample where the surface intrinsic resistant value is not larger than 1E+12Ω/square is determined to have good paper supplying and discharging property.

Example 2

A coating agent composed of 100 parts by weighs of the component (A) and 4 parts by weighs of the component (B-2) was coated on the surface of the support made of the laminated stretched resin film obtained in Production example 1 of support using a roll coater and dried to a thickness of the dry coated layer of 0.06 g/m$^2$. A film was obtained.

Examples 3 and 4

By following the same procedure as Example 2 except that the coated amount on the support was changed as shown in Table 1, each film was obtained and evaluated The results are shown in Table 1.

Examples 5 and 6

By following the same procedure as Example 3 except that the support of the laminated stretched resin film was changed as shown in Table 1, each film was obtained and evaluated. The results are shown in Table 1.

Comparative Example 1

The primer layer (B used in Example 3 of Japanese Patent Laid-Open No. 80684/1996) was coated on both surfaces of the laminated stretched resin film described in Production example of support and dried such that the thickness of the dry coated layer became 0.06 g/m$^2$. A film was obtained and evaluated. The results are shown in Table 2.

Comparative Examples 2 and 3

By following he same procedure as Example 1 except that the components of the coating agents and the coated amounts were changed as shown in Table 2, each film was obtained and evaluated. The results are shown in Table 2.

Comparative Examples 4 and 5

By following the same procedure as Comparative Example 3 except that the support of the laminated stretched resin film was changed as shown in Table 2, each film was obtained and evaluated. The results are shown in Table 2.

Comparative Example 6

By following the same procedure as Comparative Example 3 except that the components of the coating agent were changed as shown in Table 2, a film was obtained and evaluated. The results are shown in Table 2.

Examples 7 to 12

By following the same procedure as Example 3 except that the components of the coating agent were changed as shown in Table 1, each film was obtained and evaluated. The results are shown in Table 1.

Comparative Example 7

By following the same procedure as Comparative Example 3 except that the components of the coating agent were changed as shown in Table 2, a film was obtained and evaluated. The results are shown in Table 2.

TABLE 1

| | | EXAMPLE | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Production example (P.E.) of support | | P.E. 1 | P.E. 1 | P.E. 1 | P.E. 1 | P.E. 2 | P.E. 3 | P.E. 1 | P.E. 1 | P.E. 1 | P.E. 1 | P.E. 1 | P.E. 1 |
| Compound of coating agent (weight parts) | Component (A) | 100 | 100 | 100 | 100 | 100 | 100 | 100 | 100 | 100 | 100 | 100 | 100 |
| | Component (B-1) | 0 | 0 | 0 | 0 | 0 | 0 | 4 | 0 | 0 | 4 | 0 | 0 |
| | Component (B-2) | 0 | 4 | 4 | 4 | 4 | 4 | 0 | 4 | 4 | 0 | 8 | 12 |
| | Component (C) | 0 | 0 | 0 | 0 | 0 | 0 | 0 | 4 | 4 | 4 | 8 | 12 |
| | Component (D) | 0 | 0 | 0 | 0 | 0 | 0 | 0 | 0 | 4 | 4 | 8 | 12 |
| Coated amount ($g/m^2$) | | 0.06 | 0.06 | 0.15 | 0.25 | 0.15 | 0.15 | 0.15 | 0.15 | 0.15 | 0.15 | 0.15 | 0.15 |
| Melt transferring property | Ink transferring property | B | B | A | A | A | A | A | A | A | A | A | B |
| | Ink adhesion | C | C | B | B | B | B | B | B | B | B | B | C |
| Printability | Ink transferring property | 1.4 | 1.4 | 1.5 | 1.6 | 1.5 | 1.5 | 1.5 | 1.5 | 1.5 | 1.5 | 1.5 | 1.5 |
| | Ink adhesion | 1.3 | 1.4 | 1.4 | 1.4 | 1.4 | 1.4 | 1.4 | 1.5 | 1.5 | 1.5 | 1.4 | 1.5 |
| Surface intrinsic resistance (Ω) (23° C./50%) | | 1.E+14 | 1.E+14 | 1.E+14 | 1.E+14 | 1.E+14 | 1.E+14 | 1.E+14 | 1.E+14 | 1.E+10 | 1.E+10 | 5.E+09 | 1.E+09 |

TABLE 2

| | | COMPARATIVE EXAMPLE | | | | | | |
|---|---|---|---|---|---|---|---|---|
| | | 1 | 2 | 3 | 4 | 5 | 6 | 7 |
| Production example (P.E.) of support | | P.E. 1 | P.E. 1 | P.E. 1 | P.E. 2 | P.E. 3 | P.E. 1 | P.E. 1 |
| Compound or coating agent (weight parts) | Component (A) | Primer layer (B) used in Example 3 of Japanese Laid-Open No. 80684/1996 | 100 | 100 | 100 | 100 | 100 | 100 |
| | Component (B-1) | | 0 | 0 | 0 | 0 | 4 | 0 |
| | Component (B-2) | | 0 | 4 | 4 | 4 | 0 | 40 |
| | Component (C) | | 0 | 4 | 4 | 4 | 4 | 40 |
| | Component (D) | | 0 | 4 | 4 | 4 | 4 | 40 |
| Coated amount ($g/m^2$) | | 0.06 | 0.01 | 0.01 | 0.01 | 0.01 | 0.01 | 0.15 |
| Melt transferring property | Ink transferring property | F | D | D | D | D | D | B |
| | Ink adhesion | N/G | F | F | F | F | F | D |
| Printability | Ink transferring property | 1.5 | 1.4 | 1.4 | 1.4 | 1.4 | 1.4 | 1.5 |
| | Ink adhesion | 1.5 | 0.9 | 0.9 | 0.9 | 0.9 | 0.9 | 0.9 |
| Surface intrinsic resistance (Ω) (23° C./50%) | | 1.E+09 | 1.E+14 | 1.E+12 | 1.E+12 | 1.E+12 | 1.E+12 | 5.E+08 |

According to the invention, a heat transfer film excellent in transferring property and adhesion of ink can be obtained. The heat transfer film gives clear images in a heat transfer printer. Particularly, a thermoplastic resin film which is a melt heat transfer film is excellent in transferring property and adhesion of ink in various printing systems can be provided.

The priority document of the present application, Japanese Patent Application No. Hei. 11-344554, filed Dec. 3, 1999, is incorporated herein by reference.

Obviously, numerous modifications and variations of the present invention are possible in light of the above teachings. It is therefore to be understood that within the scope of the appended claims, the invention may be practiced other wise than as specifically described herein.

What is claimed is:

1. An image-receiving film for printing and heat transfer, comprising:

a support comprising a thermoplastic resin film; and a coated layer formed on said thermoplastic resin film;

wherein said coated layer comprises a dried aqueous resin dispersion as component (A), obtained by dispersing an olefin copolymer (a) having an unsaturated carboxylic acid or an unsaturated carboxylic acid anhydride in water, using at least one dispersing agent (b) selected from the group consisting of a nonionic surface active agent, a nonionic water-soluble high molecular compound, a cationic surface active agent and a cationic water-soluble high molecular compound;

wherein a weight ratio of(a)/(b) is from 100/1 to 100/30 based on a total weight of solid components in said aqueous resin dispersion; and wherein said olefin copolymer (a) and said dispersing agent (b) each, independently, have a mean particle size of not larger than 5 μm.

2. The image-receiving film according to claim 1, wherein said coated layer contains as a component (B) a polyimine polymer or an ethyleneimine addition product of polyamine-polyamide represented by formula (I):

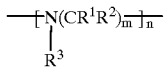

(I)

wherein $R^1$ and $R^2$ each independently represent a hydrogen atom, a straight chain or branched alkyl group having from 1 to 10 carbon atoms, an alicyclic alkyl group, or an aryl group;

$R^3$ represents a hydrogen atom, an alkyl group having from 1 to 20 carbon atoms, an allyl group, an alicyclic alkyl group, an aryl group, or the hydroxide thereof;

m represents an integer of from 2 to 6; and n represents an integer of from 20 to 3000.

3. The image-receiving film according to claim 2, wherein said coated layer comprises a crosslinking agent (C) obtained from an epichlorohydrin addition product of polyamninepolyamide, a bisphenol A-epichlorohydrin resin, an aliphatic epoxy resin, an epoxynovolac resin, an alicyclic novolac resin or a brominated epoxy resin.

4. The image-receiving film according to claim 3, wherein said coated layer contains a polymeric antistatic agent as a component (D).

5. The image-receiving film according to claim 4, wherein an amount of said component (B) in said coated layer is from 1 to 25 parts by weight;

wherein an amount of said component (C) in said coated layer is from 1 to 25 parts by weight; and wherein an amount of said component (D) in said coated layer is from 1 to 25 parts by weight based on 100 parts by weight of said component (A).

6. The image-receiving film according to claim 3, wherein an amount of said component (B) in said coated layer is from 1 to 25 parts by weight and an amount of said component (C) is from 1 to 25 pats by weight based on 100 parts by weight of said component (A).

7. The image-receiving film according to claim 2, wherein said coated layer contains a polymeric antistatic agent as a component (D).

8. The image-receiving film according to claim 7, wherein an amount of said component (B) in said coated layer is from 1 to 25 parts by weight and an amount of said component (D) is from 1 to 25 parts by weight based on 100 parts by weight of said component (A).

9. The image-receiving film according to claim 2, wherein an amount of said component (B) in said coated layer is from 1 to 25 parts by weight based on 100 parts by weight of said component (A).

10. The image-receiving film according to claim 1, wherein said support contains at least one material selected from the group consisting of an inorganic fine powder and an organic filler.

11. The image-receiving film according to claim 10, wherein said inorganic fine powder is calcium carbonate having a particle size of from 0.01 to 15 $\mu$m.

12. The image-receiving film according to claim 10, wherein said organic filler is selected from the group consisting of polyethylene terephthalate, polybutylene terephthalate, polycarbonate, nylon-6, nylon-6,6, a homopolymer of a cyclic olefin and a copolymer of a cyclic olefin and ethylene.

13. The image-receiving film according to claim 10, wherein said organic filler has a melting point of from 120 to 300° C. or a glass transition temperature of from 120 to 280° C.

14. The image-receiving film according to claim 10, wherein said organic filler has a mean particle size of from 0.01 to 15 $\mu$m.

15. The image-receiving film according to claim 1, wherein said olefin copolymer (a) is selected from the group consisting of an ethylene (meth)acrylic acid copolymer, an alkali or alkaline earth metal salt of an ethylene-(meth) acrylic acid copolymer, an ethylene(meth)acrylic acid ester-maleic anhydride copolymer, a (meth)acrylic acid graft polyethylene, a maleic anhydride g polyethylene, a maleic anhydride graft ethylene-vinyl acetate copolymer, a maleic anhydride graft (meth)acrylic acid ester-ethylene copolymer, a maleic anhydride graft polypropylene, a maleic anhydride graft ethylene-propylene copolymer, a maleic anhydride graft ethylene-propylene-butene copolymer and a maleic anhydride graft ethylene-butene copolymer, a maleic anhydride graft propylene-butene copolymer and combinations thereof.

16. The image-receiving film according to claim 1, wherein the coating agent is present in an amount of from 0.03 to 5 g/m$^2$.

17. The image-receiving film according to claim 1, wherein said thermoplastic resin film is selected from the group consisting of a polyolefin resin, a polyamide resin, a thermoplastic polyester resin, an aliphatic polyester, a polycarbonate, an atactic polystyrene, a syndiotactic polystyrene and combinations thereof.

18. The image-receiving film according to claim 1, wherein said support is stretched in at least one direction, thereby providing a stretched support.

19. The image-receiving film according to claim 18, wherein said stretched support has a void ratio of from 5 to 60%.

20. The image-receiving film according to claim 1, wherein said support has thickness of from 20 to 350 $\mu$m.

21. A method of producing the image-receiving film according to claim 1, comprising:

dispersing the olefin copolymer (a) in water using at least one dispersing agent (b), thereby providing the aqueous resin diversion (A); and coating said aqueous resin dispersion (A) on said support thereby providing said image-receiving film.

22. The method according to claim 21, further comprising:

adding component (B);

wherein said component (B) is a polyimine polymer or an ethyleneimine addition product of polyaminepolyamide represented by formula (I):

$$-\left[\underset{\underset{R^3}{|}}{N}(CR^1R^2)_m\right]_n- \quad \text{(I)}$$

wherein $R^1$ and $R^2$ each independently represent a hydrogen atom, a straight chain or branched alkyl group having from 1 to 10 carbon atoms, an alicyclic alkyl group, or an aryl group;

$R^3$ represents a hydrogen atom, an alkyl group having from 1 to 20 carbon atoms, an allyl group, an alicyclic alkyl group, an aryl group, or the hydroxide thereof;

m represents an integer of from 2 to 6; and n represents an integer of from 20 to 3000.

23. The method according to claim 22, further comprising:

adding component (C);

wherein said component (C) is a crosslinking agent.

24. The method according to claim 23, further comprising:

adding component (D);

wherein said component (D) is a polymeric antistatic agent.

25. The method according to claim 21, further comprising:

heating said support; and stretching said support.

26. The method according to claim 21, further comprising:

applying a surface oxidation treatment to said support.

27. The method according to claim 26, wherein said surface oxidation treatment is selected from the group consisting of a corona discharging treatment, a flame treatment, a plasma treatment, a glow discharging treatment, an ozone treatment and combinations thereof.

* * * * *